US009447941B2

(12) United States Patent
Youn et al.

(10) Patent No.: US 9,447,941 B2
(45) Date of Patent: Sep. 20, 2016

(54) LAMP FOR VEHICLE

(71) Applicant: SL Corporation, Daegu (KR)

(72) Inventors: Sung Wook Youn, Gyeonsangbuk-Do (KR); Dae Kyeom Kim, Gyeonsangbuk-Do (KR); Hyo Jin Han, Gyeonsangbuk-Do (KR); Ki Beom Park, Gyeonsangbuk-Do (KR); Jin Young Park, Gyeonsangbuk-Do (KR)

(73) Assignee: SL Corporation, Daegu (KR)

( * ) Notice: Subject to any disclaimer, the term of this patent is extended or adjusted under 35 U.S.C. 154(b) by 38 days.

(21) Appl. No.: 14/579,109

(22) Filed: Dec. 22, 2014

(65) Prior Publication Data

US 2015/0260366 A1 Sep. 17, 2015

(30) Foreign Application Priority Data

Mar. 13, 2014 (KR) ..... 10-2014-0029701
Apr. 22, 2014 (KR) ..... 10-2014-0048194

(51) Int. Cl.
*F21V 17/02* (2006.01)
*F21S 8/10* (2006.01)

(52) U.S. Cl.
CPC ..... *F21S 48/1784* (2013.01); *F21S 48/1159* (2013.01); *F21S 48/1258* (2013.01); *F21S 48/1323* (2013.01); *F21S 48/1388* (2013.01); *F21S 48/145* (2013.01); *F21S 48/1747* (2013.01); *F21S 48/1778* (2013.01)

(58) Field of Classification Search
CPC ..... F21S 48/1159; F21S 48/1258; F21S 48/1388; F21S 48/14; F21S 48/145; F21S 48/1323; F21S 48/1747; F21S 48/1778; F21S 48/125; F21S 48/1305; F21S 48/2212; F21S 48/23; F21S 48/1784
See application file for complete search history.

(56) References Cited

U.S. PATENT DOCUMENTS

2003/0053319 A1* 3/2003 Yokoi ..... F21S 48/1784 362/512
2007/0147061 A1* 6/2007 Lee ..... F21S 48/145 362/513

FOREIGN PATENT DOCUMENTS

| | | |
|---|---|---|
| JP | 2004-220989 | 8/2004 |
| JP | 2013-200981 | 10/2013 |
| KP | 1020130036609 A | 4/2013 |
| KP | 1020130042060 B1 | 12/2013 |

* cited by examiner

*Primary Examiner* — Y M Lee
(74) *Attorney, Agent, or Firm* — Mintz Levin Cohn Ferris Glovsky and Popeo, P.C.; Kongsik Kim; Colleen H. Witherell

(57) ABSTRACT

A lamp for a vehicle includes a light-emitting unit including a light source and a reflector, a shield unit to form a beam pattern by blocking at least some of the light generated by the light-emitting unit, and a lens unit disposed at the front of the shield unit. The shield unit includes a first shield, which forms a first region of the shield unit, and a second shield, which is driven to cover or uncover a second region of the shield unit. The lamp, with a simpler structure, can form various beam patterns while sufficiently securing a driver's field of view.

19 Claims, 21 Drawing Sheets

LAMP FOR VEHICLE

CROSS-REFERENCE TO RELATED APPLICATIONS

This application claims priority to Korean Patent Application No. 10-2014-0029701 filed on Mar. 13, 2014 and Korean Patent Application No. 10-2014-0048194 filed on Apr. 22, 2014. The applications are incorporated herein by reference.

BACKGROUND

1. Field of the Invention

The invention relates to a lamp for a vehicle, and more particularly, to a lamp for a vehicle, which can form various beam patterns with the use of a simple structure while sufficiently securing a driver's field of view.

2. Description of the Related Art

Vehicles are equipped with lamps for illuminating nearby objects or signaling state of driving to nearby vehicles or pedestrians. For example, headlamps and fog lights are used mainly for illuminating purposes, and turn signal lights, taillights, brake lights, and side marker lights are used mainly for signaling purposes.

Headlamps may form various beam patterns such as a low beam pattern or a high beam pattern depending on the surroundings of a vehicle equipped therewith (e.g., ambient brightness, nearby vehicles, road conditions, and weather conditions). As illustrated in FIG. 1, light generated by a light source 11 of a headlamp is reflected forward by a reflector 12. At least some of the reflected light from the reflector 12 is blocked by a shield unit 13, and is thus incident upon a lens 14, thereby generating a low beam pattern, as illustrated in FIG. 2. A reflective layer may be formed on the shield unit 13. Accordingly, the light blocked by the shield unit 13 may become reusable, and as a result, the efficiency of the use of light may be improved. The location of the shield unit 13 may be varied, thereby forming a high beam pattern as illustrated in FIGS. 3 and 4.

However, when the location of the entire shield unit 13 is varied to form a high beam pattern, light may be applied to areas A that are unnecessary for the formation of a high beam pattern, as illustrated in FIG. 4. Also, since a structure for varying the location of the entire shield unit 13 is needed, the amount of space needed for varying the location of the shield unit 13 increases. Also, due to the presence of the unnecessary areas A, a road surface pattern may be irregularly formed. In addition, since light reflected toward the upper side of the lens 14 is removed by the reflective layer of the shield unit 13, a short-range field of view may not be properly secured. Accordingly, a need for a new lamp for vehicle that can sufficiently secure a short-range field of view, prevent the application of light to areas that are unnecessary for forming a high beam pattern, and reduce the amount of space needed for varying the location of the shield unit 13 still exists.

SUMMARY

Exemplary embodiments of the invention provide a lamp for a vehicle, which switches between beam patterns by covering or uncovering a predetermined portion of a shield unit that forms a high illumination intensity part of a beam pattern by blocking at least some of the light generated by a light source, and can thus reduce the amount of space needed, as compared to the case of switching between beam patterns by varying the location of the entire shield unit.

Exemplary embodiments of the invention also provide a lamp for a vehicle, which switches between beam patterns by covering or uncovering a predetermined portion of a shield unit that forms a high illumination intensity part of a beam pattern, and can thus prevent unnecessary parts from being formed in a beam pattern.

Exemplary embodiments of the invention also provide a lamp for a vehicle, which can sufficiently secure a short-range field of view, even when switching between beam patterns, by allowing light generated by a light source to be reflected toward an upper side of a lens unit by an entire shield unit except for a predetermined portion to be covered or uncovered.

Exemplary embodiments of the invention also provide a lamp for a vehicle, which can form a plurality of beam patterns at the same time by providing a light-transmitting portion in a shield unit.

Exemplary embodiments of the invention also provide a lamp for a vehicle, which can reduce optical loss by preventing light generated by a light source from being transmitted beyond a reflective region of a reflector.

However, exemplary embodiments of the invention are not restricted to those set forth herein. The above and other exemplary embodiments of the invention will become more apparent to one of ordinary skill in the art to which the invention pertains by referencing the detailed description of the invention given below.

According to an exemplary embodiment of the invention, a lamp for a vehicle includes: a light-emitting unit including a light source and a reflector, which reflects forward the light generated by the light source; a shield unit to form a beam pattern by blocking at least some of the light generated by the light-emitting unit; and a lens unit disposed at the front of the shield unit, wherein the shield unit includes a first shield, which forms a first region of the shield unit, and a second shield, which is driven to cover or uncover a second region of the shield unit.

According to the exemplary embodiments, it is possible to switch between beam patterns by covering or uncovering a predetermined portion of a shield unit that forms a high illumination intensity part of a beam pattern by blocking at least some of the light generated by a light source. Accordingly, less space may be needed for varying the location of the shield unit, and as a result, the size of a lamp for a vehicle may be reduced.

Also, since the predetermined portion of the shield unit, which forms a high illumination intensity part of a beam pattern, is covered or uncovered to switch between beam patterns, it is possible to prevent unnecessary parts from being formed in a beam pattern. As a result, it is possible to prevent a road surface beam pattern from being formed irregularly.

Also, it is possible to sufficiently secure a short-range field of view, even when switching between beam patterns, by allowing light generated by a light source to be reflected toward an upper side of a lens unit by the entire shield unit except for the predetermined portion to be covered or uncovered.

Also, it is possible to easily form different beam patterns by providing a light-transmitting portion in a shield unit.

Also, it is possible to reduce optical loss by providing an auxiliary reflector near the light source to allow the auxiliary reflector to reflect light that does not travel to a reflective region of a reflector to the reflective region of the reflector (in case where the auxiliary reflector is disposed at a front side of the light source) or allow the auxiliary reflector to form a reinforcement beam pattern (in case where the auxiliary reflector is disposed at a rear side of the light source).

Other features and exemplary embodiments will be apparent from the following detailed description, the drawings, and the claims.

DETAILED DESCRIPTION

Figure 1:
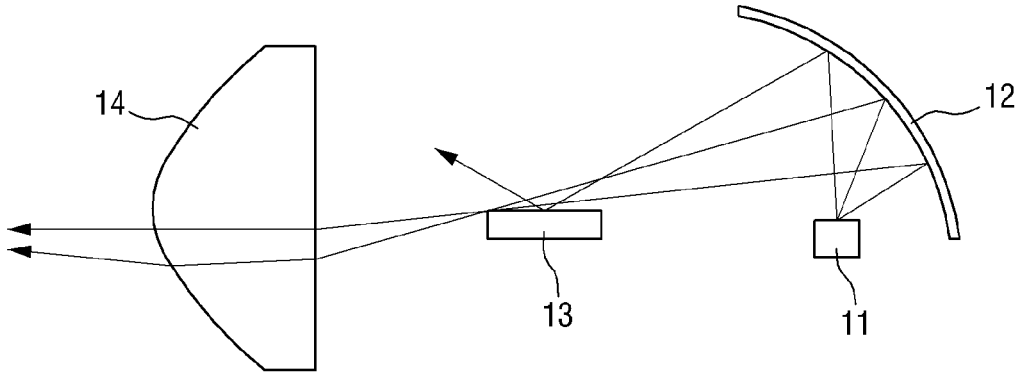
FIG. 1 is a schematic view illustrating a typical lamp for a vehicle.
Figure 2:
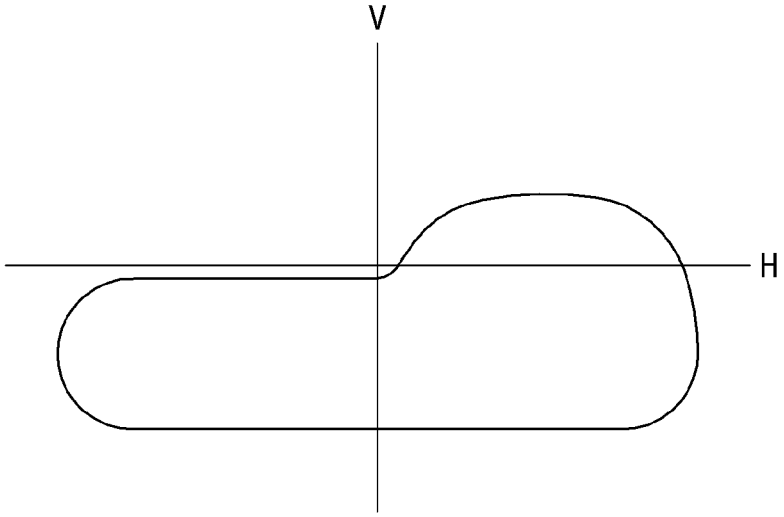
FIG. 2 is a schematic view illustrating a low beam pattern formed by the lamp of FIG. 1.
Figure 3:
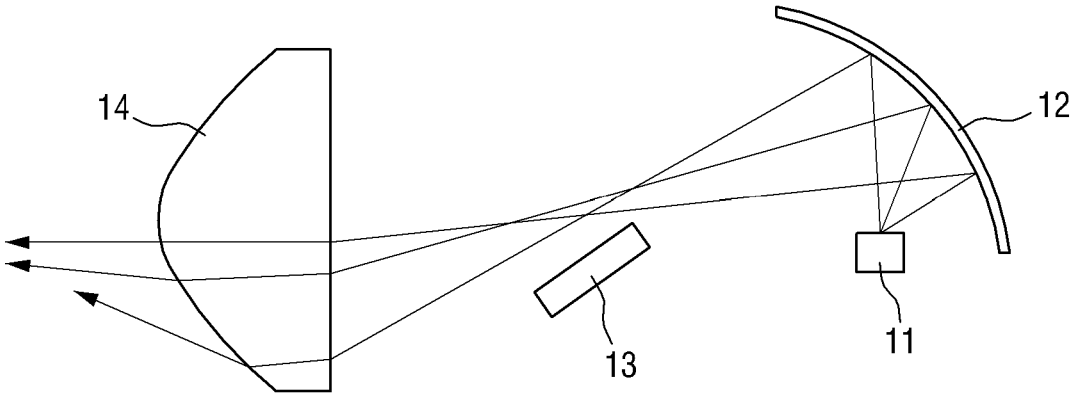
FIG. 3 is a schematic view illustrating a typical lamp for a vehicle.
Figure 4:
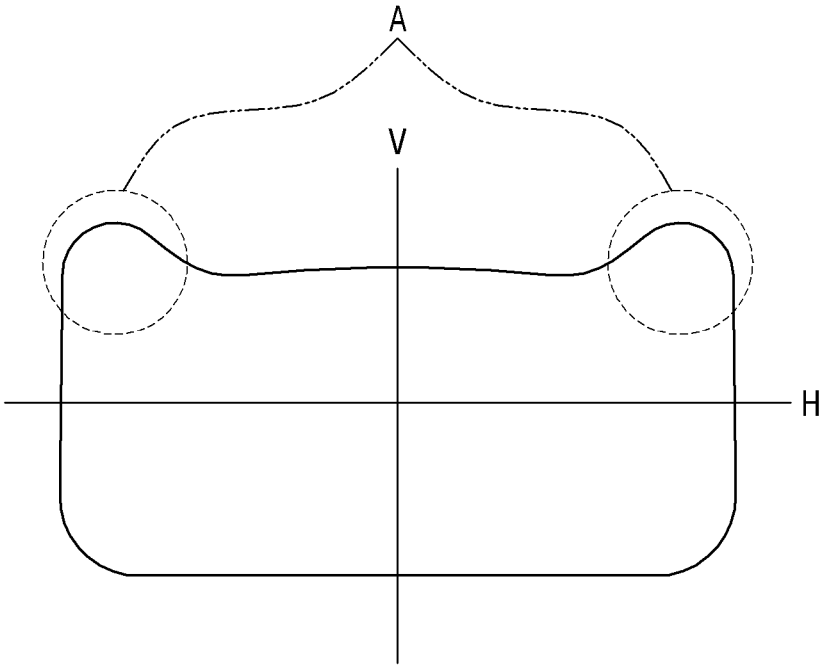
FIG. 4 is a schematic view illustrating a high beam pattern formed by the lamp of FIG. 3.

Advantages and features of the invention and methods of accomplishing the same may be understood more readily by reference to the following detailed description of exemplary embodiments and the accompanying drawings. The invention may, however, be embodied in many different provides and should not be construed as being limited to the embodiments set forth herein. Rather, these embodiments are provided so that this disclosure will be thorough and complete and will fully convey the concept of the invention to those skilled in the art, and the invention will only be defined by the appended claims. Like reference numerals refer to like elements throughout the specification.

As used herein, the singular forms "a," "an" and "the" are intended to include the plural forms as well, unless the context clearly indicates otherwise. It will be further understood that the terms "comprises (includes)" and/or "comprising (including)," when used in this specification, specify the presence of stated features, integers, steps, operations, elements, and/or components, but do not preclude the presence or addition of one or more other features, integers, steps, operations, elements, components, and/or groups thereof.

Additionally, exemplary embodiments in the description that follows will be described with reference to sectional views and/or plan views as ideal exemplary views of the invention. In the drawings, the dimensions of layers and regions are exaggerated for clarity of illustration. Accordingly, shapes illustrated in the exemplary views may be modified according to manufacturing techniques and/or allowable errors. Therefore, exemplary embodiments of the invention are not limited to the shapes illustrated in the exemplary views, but may include other shapes that may be created according to manufacturing processes.

Exemplary embodiments will hereinafter be described with reference to the accompanying drawings.

Figure 5:
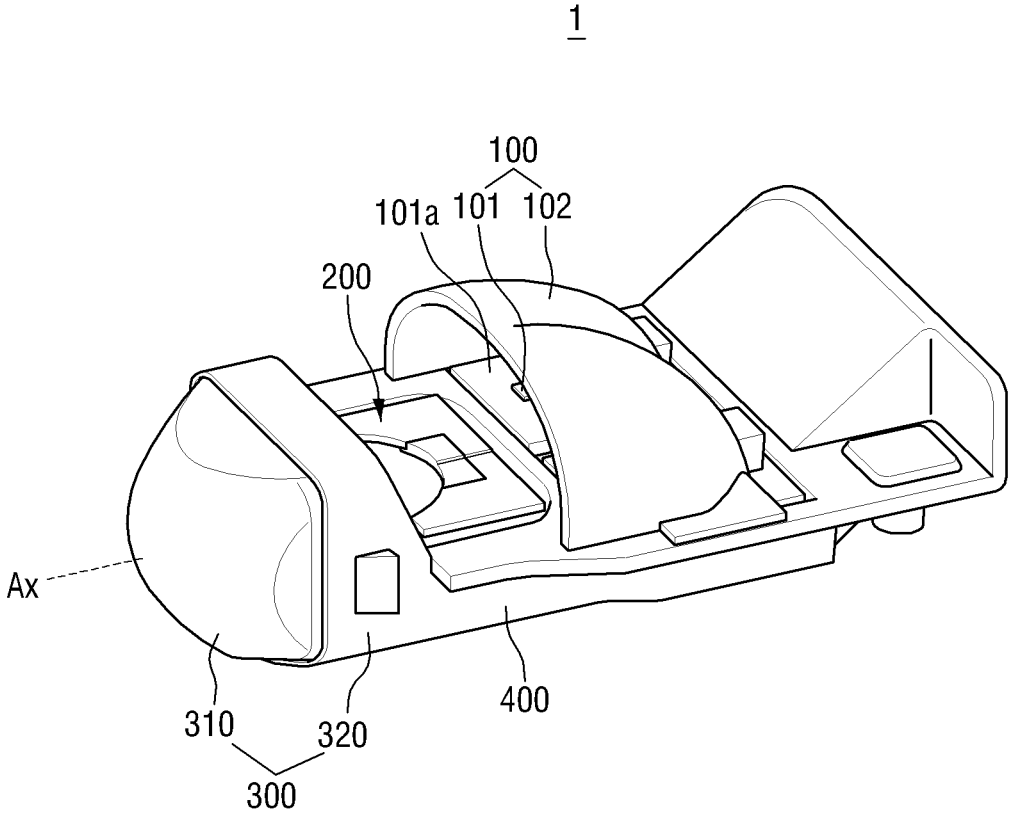
FIG. 5 is a perspective view illustrating a lamp for a vehicle according to a first exemplary embodiment of the invention.
Figure 6:
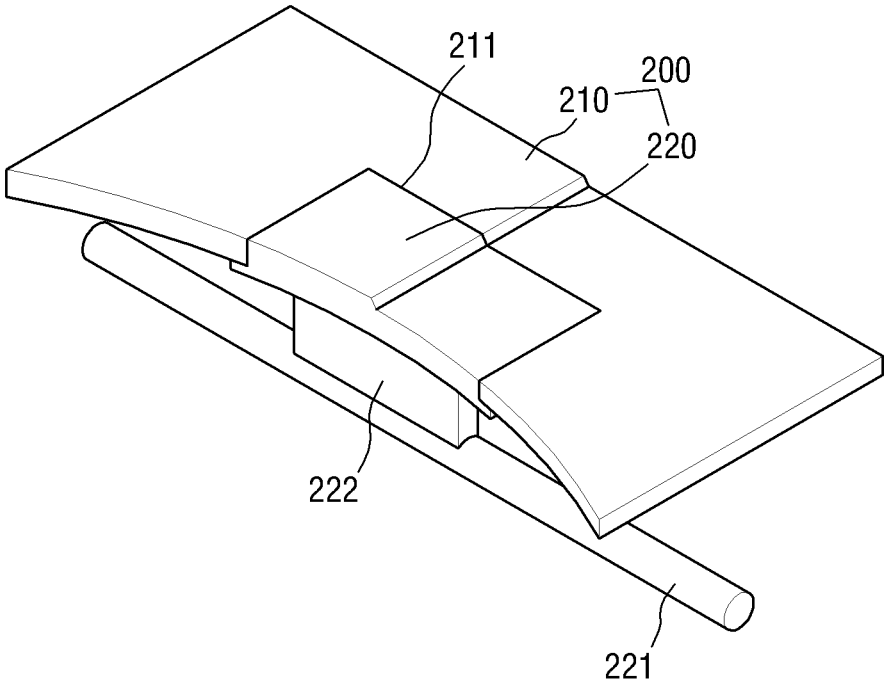
FIG. 6 is a perspective view illustrating a shield unit of the lamp of FIG. 5.
Figure 7:
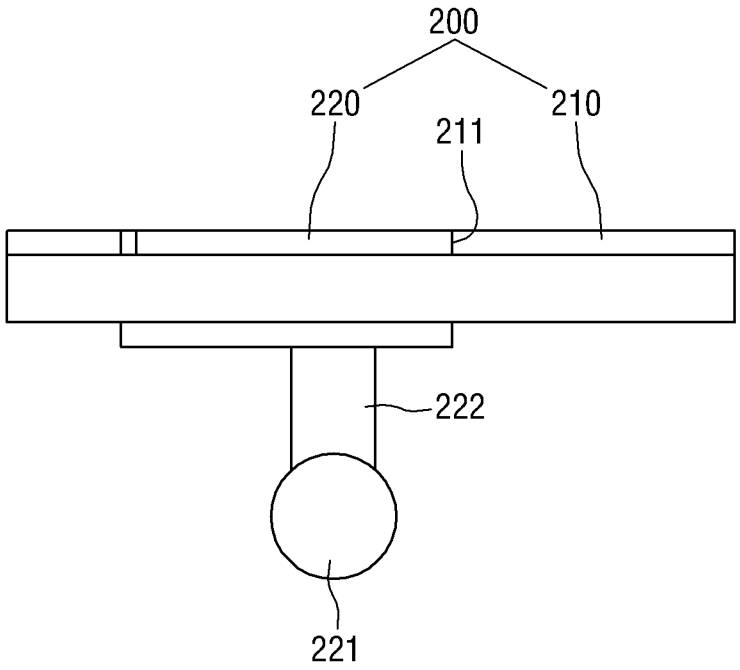
FIG. 7 is a side view illustrating the shield unit of FIG. 6.

FIG. 5 is a perspective view illustrating a lamp for a vehicle according to a first exemplary embodiment of the invention, FIG. 6 is a perspective view illustrating a shield unit of the lamp, and FIG. 7 is a side view illustrating the shield unit of FIG. 6.

Referring to FIGS. 5 to 7, a lamp 1 according to the first embodiment may include a light-emitting unit 100, a shield unit 200, a lens unit 300 and a heat sink 400. The lamp 1 may be a headlamp, but it may also be a tail lamp, a brake lamp, a turn signal lamp, or a backup lamp, for example.

The light-emitting unit 100 may generate suitable light for the use of the lamp 1. The light-emitting unit 100 may include a light source 101 and a reflector 102. A semiconductor light-emitting device, for example, a light-emitting diode (LED), may be used as the light source 101, but the invention is not limited thereto. That is, various types of light sources other than a semiconductor light-emitting device, such as a bulb, may be used. The number and color of the light source 101 may be varied depending on the amount of light required or the use of the lamp 1. In a case when the lamp 1 is used for two different purposes, two or more light sources 101 with different colors may be used together.

The light source 101 may be installed on one surface of a circuit board 101*a*. In a case when a plurality of light sources 101 are provided, the plurality of light sources 101 may be configured to share a single circuit board 101*a* together or to use different circuit boards 101*a* from each other. As many circuit boards 101*a* as there are light sources 101 may be provided and used separately.

The reflector 102 may be formed in the shape of an elliptical curved surface or a parabola with one surface thereof open so as to reflect forward light generated by the light source 101. The light source 101 may be located at a focal point of the reflector 102. The reflector 102 may have a first focal point and a second focal point. The first focal point may be designed to be near the light source 101, and the second focal point, which is at the rear of the lens unit 300, may be designed to be near the shield unit 200.

In the first exemplary embodiment, the light source 101 may generate and emit light in an upward direction, and the reflector 102, which is disposed above the light source 101, may reflect forward the light generated by the light source 101. However, the invention is not limited thereto. That is, the location of the reflector 102 may be varied depending on the layout of the lamp 1.

The reflector 102 may be disposed entirely above the light source 101, or may be disposed only partially above the light source 101.

In a case when a plurality of light sources 101 are used, as many reflectors 102 as there are light sources 101 may be provided, or a single reflector 102 may be provided and shared by the plurality of light sources 101. In the first exemplary embodiment, as many reflectors 102 as there are light sources 101 may be provided and connected together.

The shield unit 200 may be disposed at the front of the light-emitting unit 100, and may form a beam pattern with a predetermined cutoff line by blocking some of the light generated by the light-emitting unit 100.

The shield unit 200 may be formed in the shape of a plate that is at least partially horizontal, and may extend from a front end thereof, which is disposed near a rear focal point of the lens unit 300, to a rearward direction. The front end of the shield unit 200 may be formed in the shape of a curve extending with a smooth curvature toward both ends of the lens unit 300 along the surface of the rear focal point of the lens unit 300.

At least part of the shield unit 200 may be stepped according to the type of beam pattern to be formed to have a different height from the rest of the shield unit 200. The height or location of the stepped part of the shield unit 200 may be varied depending on the type of beam pattern to be formed.

The shield unit 200 may form a beam pattern with a predetermined cutoff line by blocking at least one of the light generated by the light source 101 or the light reflected from the reflector 102. A reflective layer (not illustrated), which reflects light blocked by the shield unit 200 toward an upper side of the lens unit 300, may be formed on a surface of the shield unit 200 by which light is blocked, for example, at least part of the top surface of the shield unit 200. In the first exemplary embodiment, the reflective layer may be formed on the entire top surface of the shield unit 200.

Referring to FIGS. 6 and 7, the shield unit 200 may include a first shield 210 and a second shield 220. The first shield 210 may form a first region of the shield unit 200, and the second shield 220 may form a second region of the shield unit 200. The first region and the second region may account for the entire shield unit 200.

The first shield 210 may be fixedly installed in the first region, and the second shield 220 may be driven to cover or uncover the second region and thus to selectively block light that travels toward the second region.

The first shield 210 may be formed to be connected to the reflector 102, or may be supported, and fixedly installed, by an additional element (not illustrated).

When the first shield 210 is fixedly installed, the first shield 210 may block light traveling toward the first region regardless of changes in the type of beam pattern to be formed.

The second shield 220 may cover or uncover the second region, which extends from the front end of the shield unit 200 to the rearward direction. A mounting groove 211, on or from which the second shield 220 can be mounted or removed, may be formed on the first shield 210 to conform to the shape of the second region.

In the first exemplary embodiment, light traveling toward the second region may form a high illumination intensity part of a beam pattern formed by the lamp 1 for securing a long-range field of view. In the first exemplary embodiment, the high illumination intensity part may be formed to form a high beam pattern.

The second shield 220 may be connected to a rotation axis 221 via a connecting portion 222. The rotation axis 221 is directly or indirectly connected to the rotation axis of an actuator (not illustrated), such as a motor. As a result, the second shield 220 may be rotated about the rotation axis 221 during the operation of the actuator. It may be understood that the second shield 220 may be indirectly connected to the actuator by one or more connecting elements, such as gears, disposed between the rotation axis 221 of the second shield 220 and the actuator.

Figure 8:
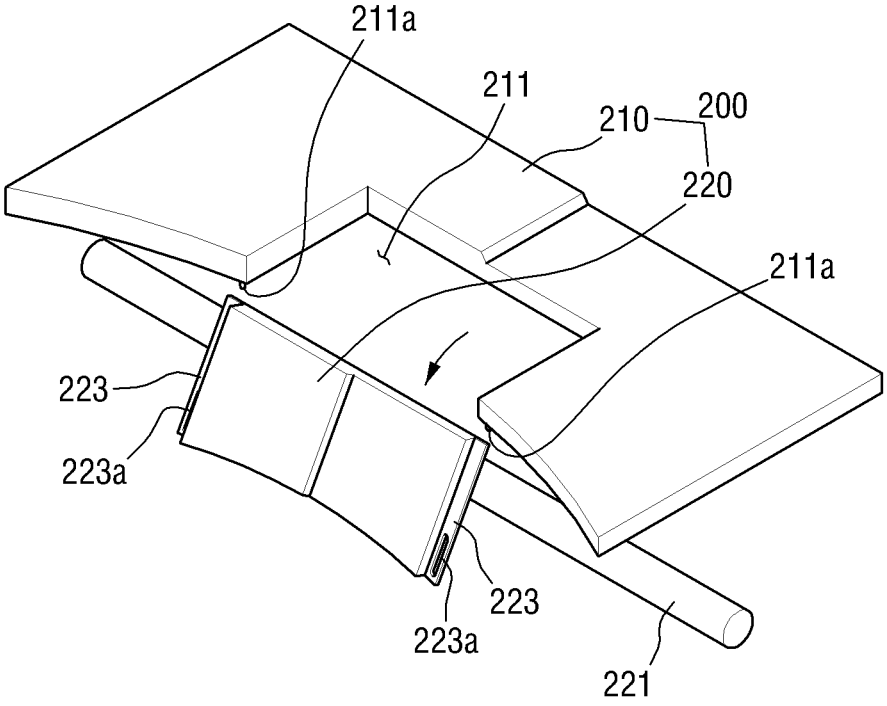
FIG. 8 is a perspective view illustrating the shield unit of FIG. 6 when the lamp forms a high beam pattern.
Figure 9:
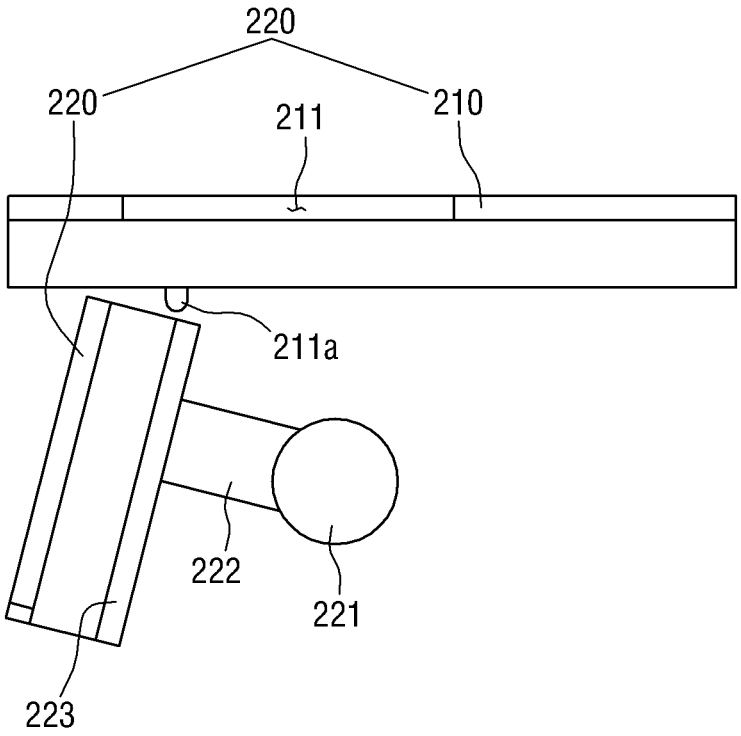
FIG. 9 is a side view illustrating the shield unit when the lamp forms a high beam pattern.

The second shield 220 may form the second region of the shield unit 200, which extends from a central part of the front end of the shield unit 200 to the rearward direction. Accordingly, in response to the second shield 220 being rotated forward about the rotation axis 221, the second region may be uncovered, as illustrated in FIGS. 8 and 9. In response to the second shield 220 being rotated reward with the second region uncovered, the second region may be covered, as illustrated in FIGS. 6 and 7.

The second shield 220 may include a guide area 223, which is formed to be stepped on either side of the second shield 220. The guide area 223 may guide the second shield 220 to be properly installed in the mounting groove 211 of the first shield 210.

For example, one or more guide groove 223*a* may be formed in the guide area 223, and one or more guide protrusions 211*a*, which are formed near the mounting groove 211 of the first shield 210, may be inserted into the guide grooves 223*a*, respectively. As a result, the location of installation of the second shield 220 may be properly aligned when mounting the second shield 220 on one side of the first shield 210.

In the first exemplary embodiment, the guide area 223 may be provided on the left and right sides, respectively, of the second shield 220, but the location and direction of the guide area 223 may be varied.

In the first exemplary embodiment, the guide grooves 223*a* may be formed on the first shield 220, and the guide protrusions 211*a* may be formed on the first shield 210. However, the invention is not limited thereto. That is, the guide grooves 223*a* may be formed on the first shield 210, and the guide protrusions 211*a* may be formed on the second shield 220, and the shapes and numbers of the guide grooves 223*a* and the guide protrusions 211*a* may be varied.

In the first exemplary embodiment, the second shield 220 may be guided by the guide grooves 223*a* and the guide protrusions 211*a*, but the invention is not limited thereto. That is, various guide structures other than that set forth herein may be used to align the location of installation of the second shield 220.

Figure 10:
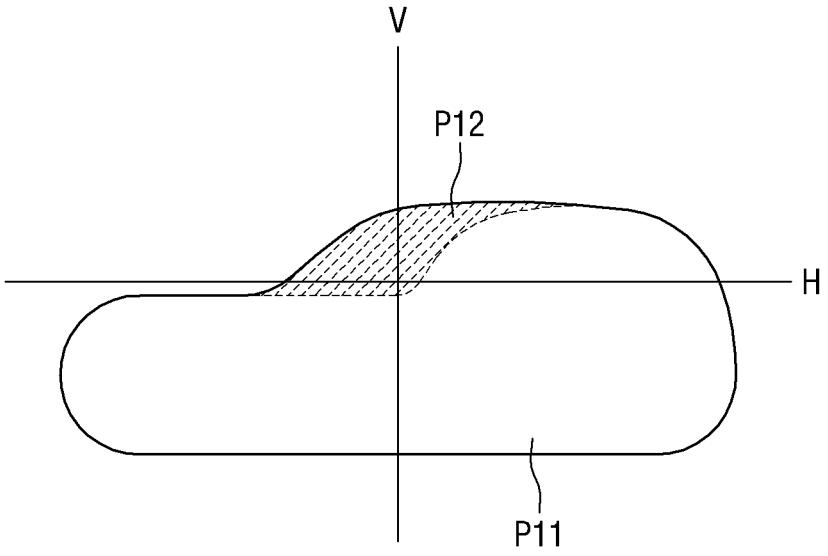
FIG. 10 is a schematic view illustrating a high beam pattern formed by the lamp of FIG. 5.

In a mode for forming a low beam pattern, the lamp 1 may form the same low beam pattern as a typical lamp for a vehicle by covering the second region with the second shield 220. On the other hand, in a mode for forming a high beam pattern, since the first shield 210 remains fixed and the second shield 220 is moved to uncover the second region, as illustrated in FIGS. 8 and 9, a high illumination intensity part P12 may be added to a low beam pattern P11, as illustrated in FIG. 10, thereby forming a high beam pattern for securing a long-range field of view.

In the first exemplary embodiment, a reflective layer (not illustrated), which reflects light blocked by the shield unit 200 toward the upper side of the lens unit 300, may be formed on the top surface of the shield unit 200. Accordingly, in a case when a high beam pattern is formed, light blocked by the first shield 210 may be incident in the direction of the upper side of the lens unit 300, thereby securing a short-range field of view.

Figure 11:
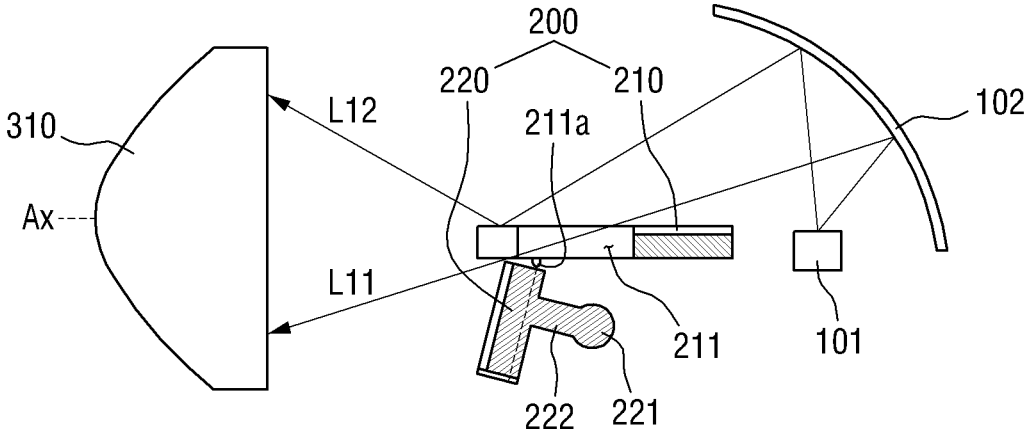
FIG. 11 is a schematic view illustrating the path of light of the lamp of FIG. 5 when it forms a high beam pattern.

That is, in a case when a high beam pattern is formed, the second shield 220 is rotated to the front of the shield unit 200, as illustrated in FIG. 11, so as to uncover the second region of the shield unit 200. Light L11, which arrives at the uncovered second region, may pass through the shield unit 200 and may form a high illumination intensity part, whereas light L2, which arrives at the first shield 210, may be reflected by the first shield 210 and may thus travel toward the upper side of the lens unit 300.

In a case when light is reflected by the first shield 210, unnecessary parts may be prevented from being formed in a high beam pattern, as opposed to when a high beam pattern is formed by varying the location of the entire shield unit 200. Also, since light reflected by the first shield 210 travels toward the upper side of the lens unit 300, the width of light for securing a short-range field of view at the front of a vehicle can be prevented from decreasing. Accordingly, it is possible to prevent a short-range field of view from narrowing while improving the efficiency of the use of light.

Some of the elements of the lamp 1 are not illustrated in FIG. 11 for convenience, and it may be understood that the elements that are not specifically illustrated in FIG. 11 are identical to their respective counterparts of FIGS. 1 to 10.

In the first exemplary embodiment, since the lamp 1 only requires a structure for varying the location of the second shield 220, which accounts only for a portion of the shield unit 200, less space may be needed than when the location of the entire shield unit 200 should be varied.

Referring back to FIG. 5, the lens unit 300 may be disposed at the front of the shield unit 200, and may include a lens 310 and a lens holder 320. The lens unit 300 may allow light transmitted through, or reflected from, the shield unit 200 to be emitted to the outside of the lamp 1. In the first exemplary embodiment, an aspheric lens with various lens properties may be used as the lens 310 depending on the direction and range of application of light.

The heat sink 400 may be disposed at one side of the light source 101 to prevent the temperature from increasing due to heat generated by the light source 101. The heat sink 400 may prevent the light emission efficiency of an LED from rapidly decreasing due to temperature increases.

In the first exemplary embodiment, the heat sink 400 may be disposed to be in contact with the bottom surface of the circuit board 101*a*, but the shape or location of the heat sink 400 may be varied to maximize the heat dissipation efficiency of the heat sink 400.

A heat pad (not illustrated) may be inserted between the circuit board 101*a* and the heat sink 400 for an improved, uniform thermal conduction.

In the first exemplary embodiment, the heat sink 400 may be used to prevent the temperature from increasing due to heat generated by the light source 101, but the invention is not limited thereto. That is, an additional cooling device, such as a cooling fan, may also be used.

In the first exemplary embodiment, the heat sink 400 and the lens unit 300 (particularly, the lens holder 320) may be integrally formed with each other so as to be connected together, but the invention is not limited thereto. That is, the lens unit 300 and the heat sink 400 may be formed separately, or may be coupled together by bolts or hooks, for example.

In the first exemplary embodiment, a single light-emitting unit 100 may be provided, and may be disposed above an optical axis Ax of the lamp 1, but the invention is not limited thereto. That is, a plurality of light-emitting units 100 may be provided, and may be disposed in different directions from each other with respect to the optical axis.

The plurality of light-emitting units 100 may be provided for forming a low beam pattern, a high beam pattern, and various other beam patterns, and may be configured to form different beam patterns at the same time.

Figure 12:
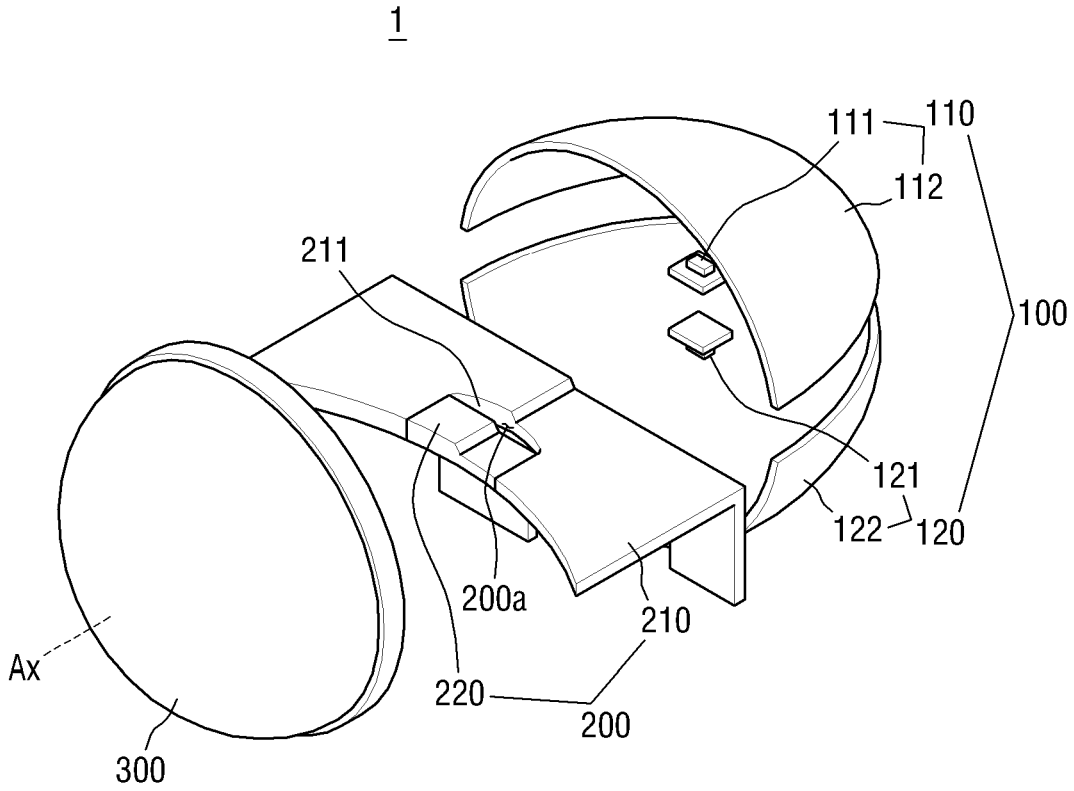
FIG. 12 is a perspective view illustrating a lamp for a vehicle according to a second exemplary embodiment of the invention.
Figure 13:
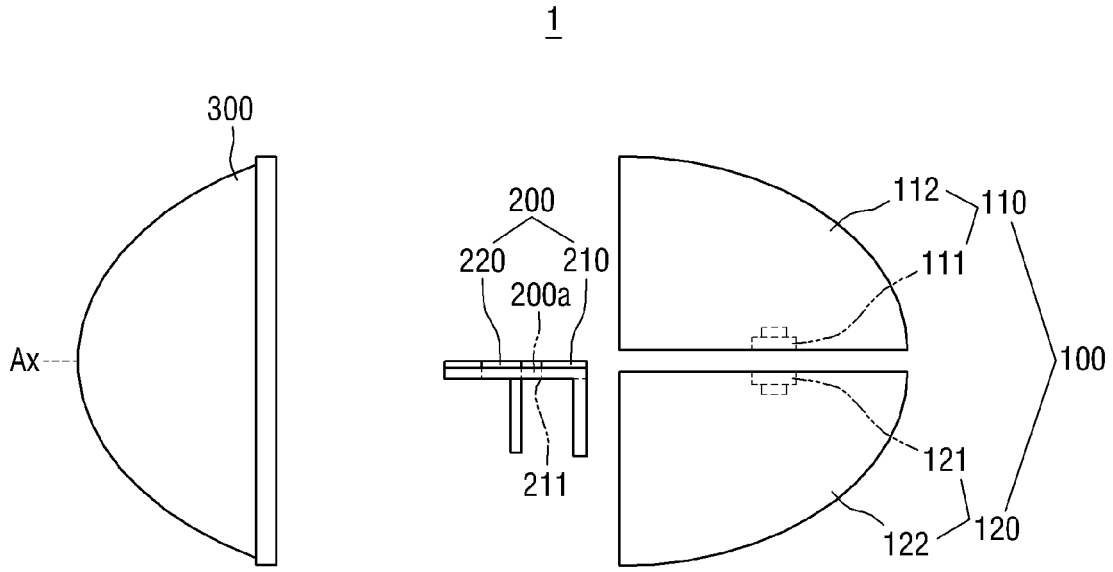
FIG. 13 is a side view illustrating the lamp of FIG. 12.

FIG. 12 is a perspective view illustrating a lamp for a vehicle according to a second exemplary embodiment of the invention, and FIG. 13 is a side view illustrating the lamp.

Referring to FIGS. 12 and 13, a lamp 1 for a vehicle may include a light-emitting unit 100, a shield unit 200 and a lens unit 300. The light-emitting unit 100 may include a plurality of light source modules, which are disposed in different directions from each other with respect to an optical axis Ax of the lamp 1.

Some of the elements of the lamp 1 of the first exemplary embodiment may not be included in the lamp 1 of the second exemplary embodiment. The elements of the lamp 1 of the second exemplary embodiment may differ in their locations and shapes from, but may serve the same functions as, their respective counterparts of the lamp of the first exemplary embodiment. In the first and second exemplary embodiments, like reference numerals indicate like elements.

In the second exemplary embodiment, the plurality of light source modules may include two light source modules, i.e., a first light source module 110 and a second light source module 120, but the invention is not limited thereto. That is, the number of the plurality of light source modules may be varied.

In the second exemplary embodiment, the first light source 110 and the second light source module 120 may be disposed above and below, respectively, the optical axis Ax, but the invention is not limited thereto. That is, the directions in which to arrange the first light source module 110 and the second light source module 120, respectively, may be varied depending on the type of beam pattern to be formed. More than one first light source module 110 and more than one second light source module 120 may be provided.

The first light source module 110 may include a first light source 111 and a first reflector 112. The first reflector 112 may be disposed above the first light source 111, which generates and emits light in an upward direction, and may reflect forward the light generated by the first light source 111. In the second exemplary embodiment, the first light source module 110 may be used to form a low beam pattern.

The first reflector 112 may be disposed entirely above the first light source 111, or may be disposed only partially above the first light source 111.

The second light source module 120 may include a second light source 121 and a second reflector 122. The second reflector 122 may be disposed below the second light source 121, which generates and emits light in a downward direction, and may reflect forward the light generated by the second light source 121.

In the second exemplary embodiment, the second light source module 120 may be used to form a reinforcement beam pattern for reinforcing a predetermined part of a beam pattern formed by the first light source module 110, but the invention is not limited thereto. That is, the second light source module 120 may form a different beam pattern from the first light source module 110. For example, the second light source module 120 may be used together with the first light source module 110 to form a beam pattern for securing a long-range field of view and thus to form a high beam pattern.

The second reflector 122 may be disposed entirely below the second light source 121, or may be disposed only partially above the second light source 121.

The shield unit 200 may include a first shield 210 and a second shield 220. A light-transmitting portion 200*a* may be formed between the first shield 210 and the second shield 220.

The first shield 210 may be fixedly installed in a first region of the shield unit 200, and the second shield 220 may be driven to cover or uncover a second region of the shield unit 200. The first shield 210 and the second shield 220 are similar to their respective counterparts of the first exemplary embodiment, and thus, detailed descriptions thereof will be omitted.

In response to the second shield 220 being placed to cover the second region, a gap between the first shield 210 and the second shield 220 may form the light-transmitting portion 200*a*. The light-transmitting portion 200*a* may be formed near a rear focal point of thee lens unit 300.

More specifically, the second region of the shield unit 200 may extend from the center of a front end of the shield unit 200 to a rearward direction. A mounting groove 211, on or from which the second shield 220 can be mounted or removed, may be formed at the front end of the first shield 210. In response to the second shield 220 being placed to cover the second region, a rear end of the second shield 220 and a corresponding side of the mounting groove 211 may be separated from each other by a predetermined distance, and as a result, the light-transmitting portion 200*a* may be formed.

In the second exemplary embodiment, the light-transmitting portion 200*a* may be formed is as a hole, but the invention is not limited thereto. That is, the light-transmitting portion 200*a* may be formed as a groove, a transmissive film capable of transmitting light therethrough, or a combination thereof.

Figure 14:
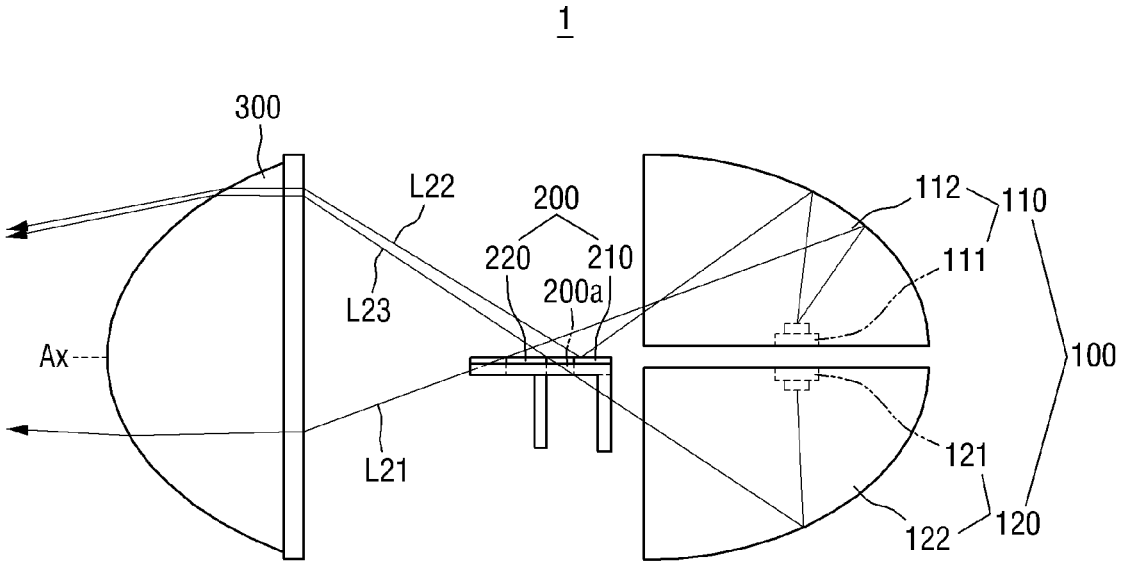
FIG. 14 is a schematic view illustrating the path of light of the lamp of FIG. 12 when it forms a low beam pattern.
Figure 15:
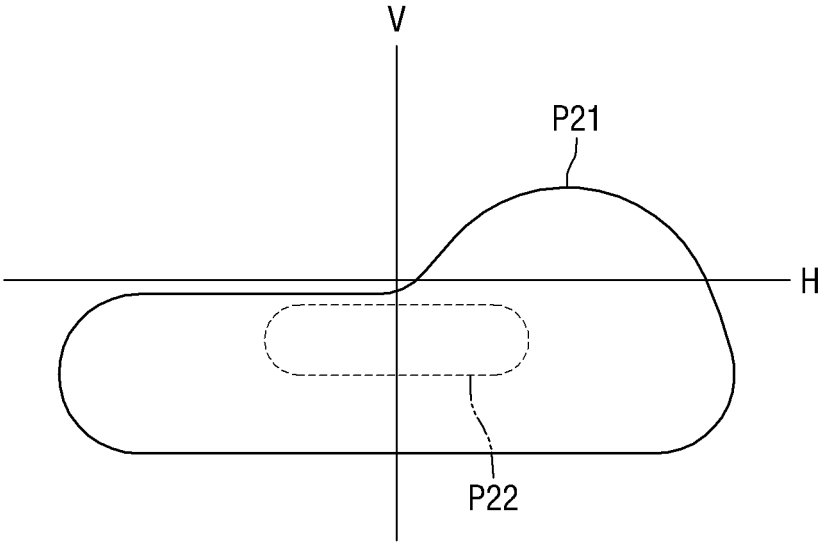
FIG. 15 is a schematic view illustrating a low beam pattern formed by the lamp of FIG. 12.

Referring to FIGS. 14 and 15, in response to the second shield 220 being placed to cover the second region, some of the light generated by the first light source module 110, i.e., light L21, may pass through the shield unit 200, some other light generated by the first light source module 110, i.e., light L22, may be reflected toward an upper side of the lens unit 300 by the shield unit 200 and may form a low beam pattern P21, and some of the light generated by the second light source module 120, i.e., light L23, may pass through the light-transmitting portion 200*a* and may form a reinforcement beam pattern P22 that reinforces a predetermined part of the low beam pattern P21.

Figure 16:
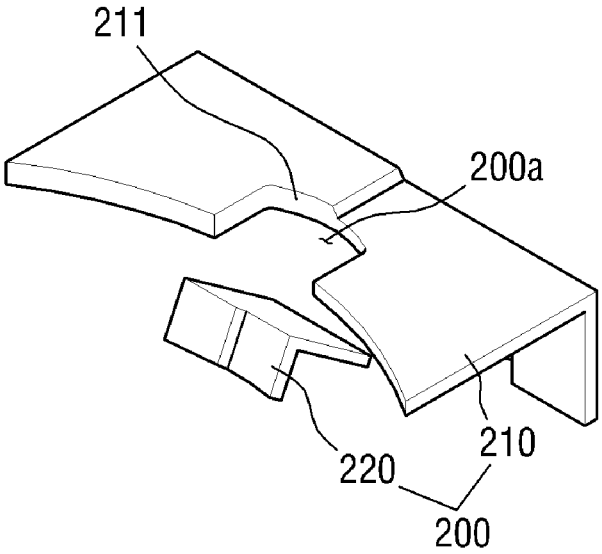
FIG. 16 is a perspective view illustrating a shield unit of the lamp of FIG. 12 when the lamp forms a high beam pattern.
Figure 17:
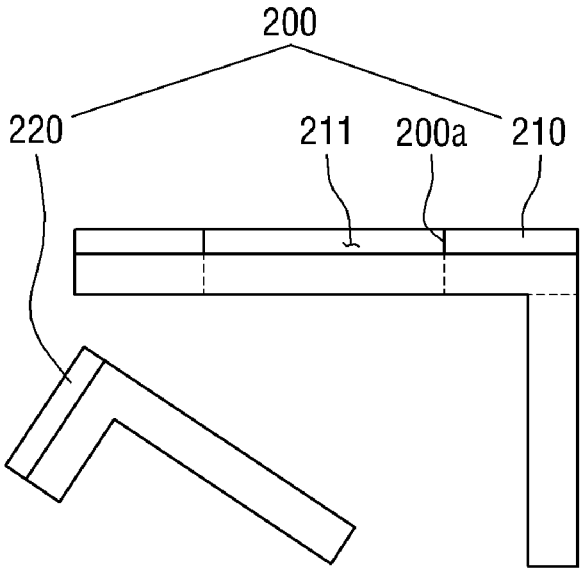
FIG. 17 is a side view illustrating the shield unit of FIG. 16.
Figure 18:
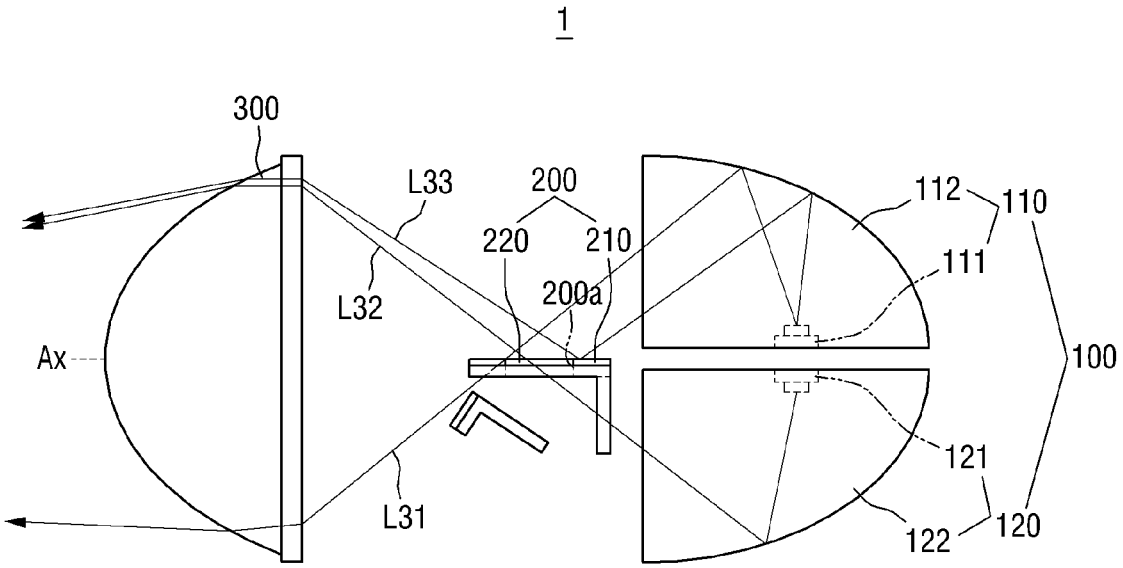
FIG. 18 is a schematic view illustrating the path of light of the lamp of lamp of FIG. 12 when the lamp forms a high beam pattern.
Figure 19:
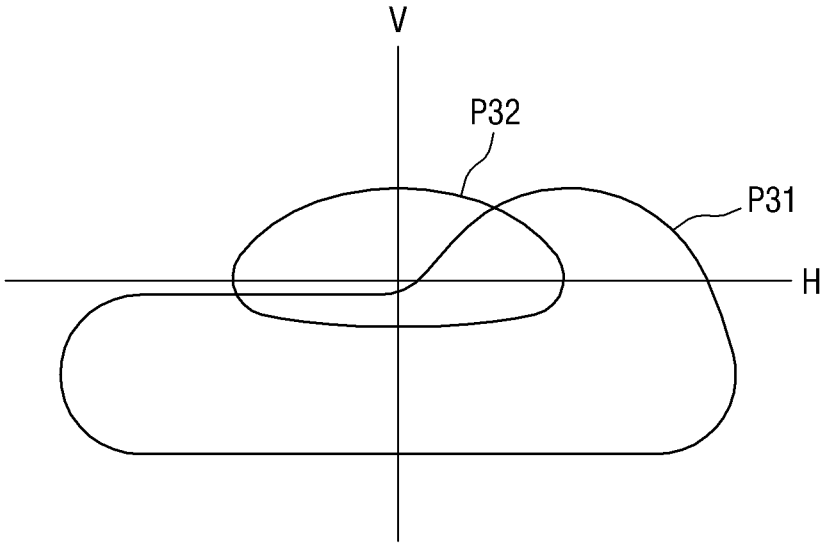
FIG. 19 is a schematic view illustrating a high beam pattern formed by the lamp of FIG. 12.

Referring to FIGS. 16 and 17, in a case when a high beam pattern is formed, the second shield 220 may be rotated to the front of the shield unit 200 by an actuator (not illustrated), and the second region of the shield unit 200 may be uncovered. Accordingly, light generated by the second light source module 120, which is disposed below the optical axis Ax, may pass through the second region and the light-transmitting portion 200*a*, and as a result, a high beam pattern capable of securing not only a long-range field of view, but also, a short-range field of view that can be provided by the first light source module 110, may be formed.

That is, in response to the second shield 220 being rotated to the front of the shield unit 200, as illustrated in FIGS. 16 and 17, light L31 generated by the first light source module 110 may be partially blocked by the first shield 210 and may form a low beam pattern P31, and light L32 generated by the second light source module 120 may form a beam pattern P32 for securing a low-range field of view. As a result, a high beam pattern may be formed. Light L33 blocked by the first shield 210 may be reflected toward the upper side of the lens unit 300 and may improve a short-range field of view.

In the second exemplary embodiment, like in the first exemplary embodiment, the first shield 210 may be fixedly installed, and the second shield 220, which is disposed at the center of the front end of the shield unit 200, may be driven to switch between beam patterns. Accordingly, unnecessary parts may be prevented from being formed in a high beam pattern, as opposed to when a high beam pattern is formed by varying the location of the entire shield unit 200. Also, since light reflected by the first shield 210 can be reused, a short-range field of view can be secured.

Also, in the second exemplary embodiment, like in the first exemplary embodiment, since the lamp 1 only requires a structure for varying the location of the second shield 220, rather than the location of the entire shield unit 200, less space may be needed than when the location of the entire shield unit 200 should be varied.

In the second exemplary embodiment, the shield unit 200 may include the first shield 210 and the second shield 220 with the light-transmitting portion 200*a* formed therebetween, but the invention is not limited thereto. That is, the shield unit 200 may be formed in one piece, in which case, the light-transmitting portion 200*a* may also be formed near the rear focal point of the lens unit 300.

Figure 20:
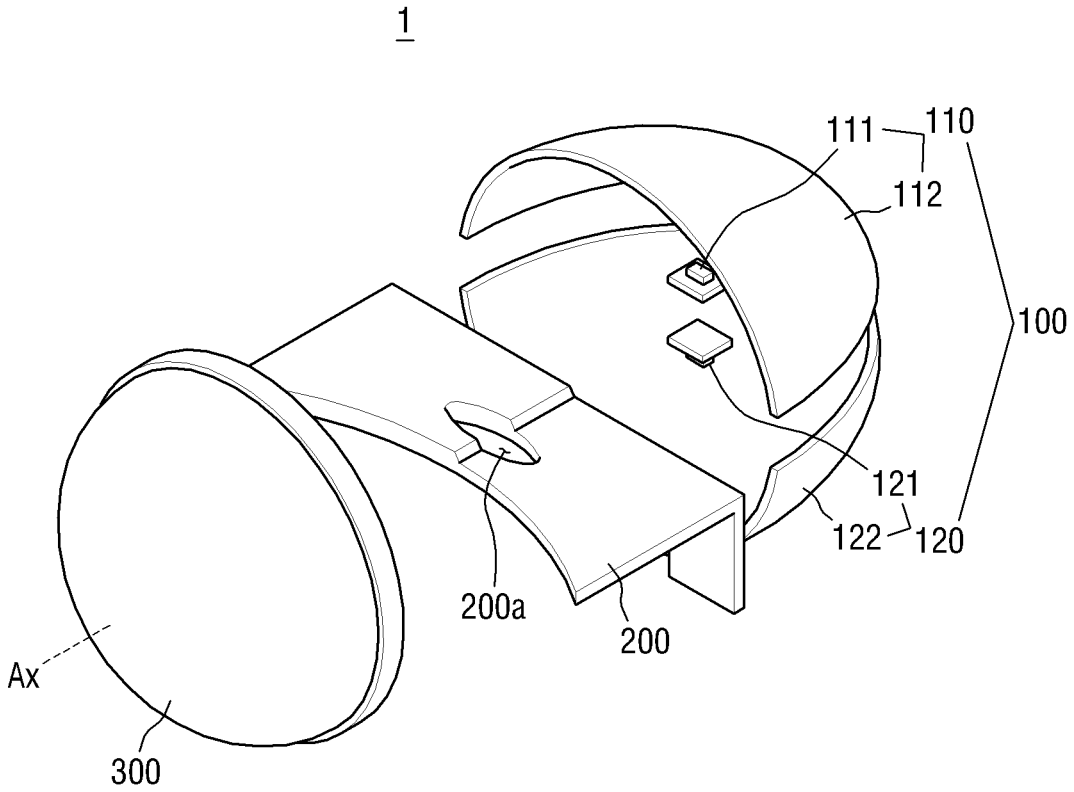
FIG. 20 is a perspective view illustrating a lamp for a vehicle according to a third exemplary embodiment of the invention.
Figure 21:
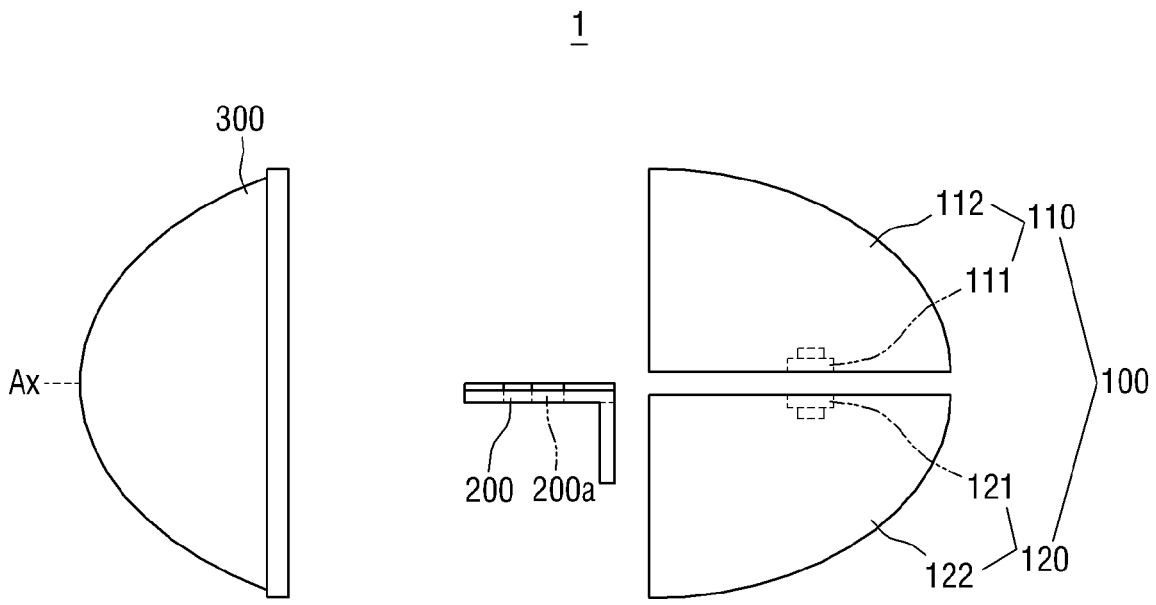
FIG. 21 is a side view illustrating the lamp of FIG. 21.

FIG. 20 is a perspective view illustrating a lamp for a vehicle according to a third exemplary embodiment of the invention, and FIG. 21 is a side view illustrating the lamp. More specifically, FIGS. 20 and 21 illustrate an example of a lamp for a vehicle in which a light-transmitting portion 200*a* is provided in a shield unit 200 that is formed in one piece.

Referring to FIGS. 20 and 21, a lamp 1 for a vehicle, like its counterpart of the first exemplary embodiment, may include a light-emitting unit 100, a shield unit 200 and a lens unit 300. The light-emitting unit 100, the shield unit 200 and the lens unit 300 are similar to their respective counterparts of the lamp of the first exemplary embodiment, and thus, detailed descriptions thereof will be omitted.

Some of the elements of the lamp 1 of the first exemplary embodiment may not be included in the lamp 1 of the third exemplary embodiment. The elements of the lamp 1 of the third exemplary embodiment may differ in their locations and shapes from, but may serve the same functions as, their respective counterparts of the lamp of the first exemplary embodiment. In the first and third exemplary embodiments, like reference numerals indicate like elements.

In the third exemplary embodiment, the shield unit 200 may be implemented as a one-piece element, and the light-transmitting portion 200*a*, which transmits light therethrough, may be formed near a rear focal point of the lens unit 300.

The shield unit 200 may form a beam pattern by blocking some of the light generated by a first light source module 110, and the light-transmitting portion 200*a* of the shield unit 200 may form a reinforcement beam pattern, which reinforces a predetermined part of the beam pattern formed by the first light source module 110, by transmitting some of the light generated by a second light source module 120 therethrough.

Figure 22:
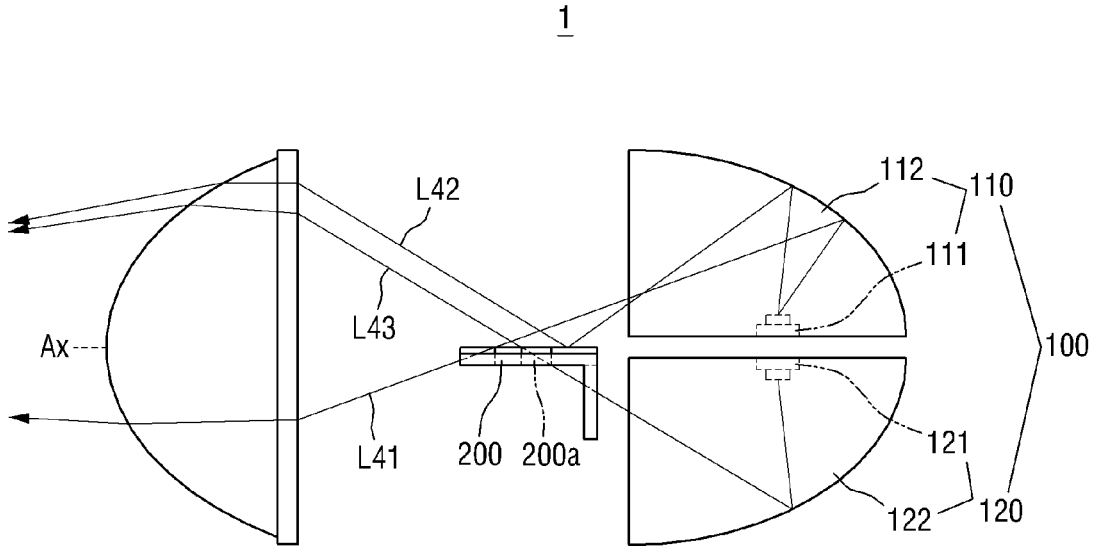
FIG. 22 is a schematic view illustrating the path of light of the lamp of FIG. 21.

For example, as illustrated in FIG. 22, some of the light generated by the first light source module 110, i.e., light L41, may pass through the shield unit 200, and some other light generated by the first light source module 110, i.e., light L42, may be blocked by the shield unit 200 and may be reflected toward an upper side of the lens unit 300 and may form the low beam pattern P21 of FIG. 15. Some of the light generated by the second light source module 120, i.e., light L43, may pass through the light-transmitting portion 200*a* of the shield unit 200 and may form the reinforcement beam pattern P22 of FIG. 15, which reinforces a predetermined part of the low beam pattern P21, to improve a short-range field of view.

Figure 23:
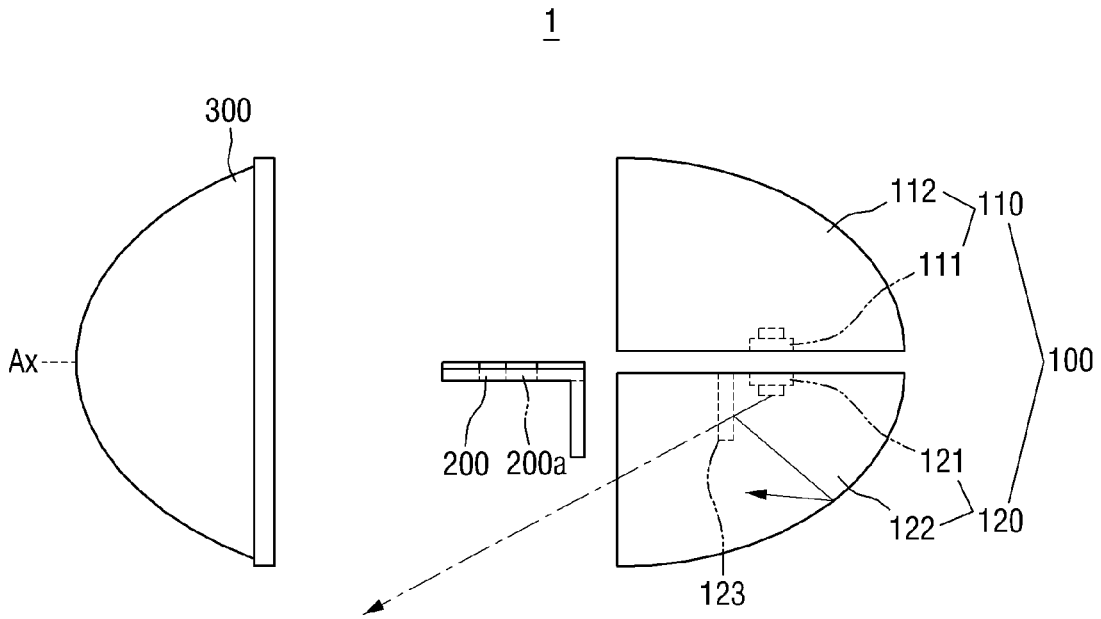
FIG. 23 is a side view illustrating a lamp for a vehicle according to a fourth exemplary embodiment of the invention.

FIG. 23 is a side view illustrating a lamp for a vehicle according to a fourth exemplary embodiment of the invention.

Referring to FIG. 23, a lamp 1 for a vehicle, like its counterparts of the lamp of the first third exemplary embodiment, may include a light source unit 100, a shield unit 200 and a lens unit 300. The light-emitting unit 100, the shield unit 200 and the lens unit 300 are similar to their respective counterparts of the lamp of the first exemplary embodiment, and thus, detailed descriptions thereof will be omitted.

In the fourth exemplary embodiment, a second light source module 120 may include a second light source 121 and a second reflector 122, and may also include an auxiliary reflector 123, which is disposed near the second light source 121. The auxiliary reflector 123 may prevent optical loss that may be caused by some of the light generated by the second light source 121 traveling transmitted beyond a reflective region of the second reflector 122.

That is, some of the light generated by the second light source 121 may travel beyond the reflective region of the second reflector 122, as indicated by a dotted line, and as a result, optical loss may occur. Since the auxiliary reflector 123 is provided near the second light source 121, light emitted from the second light source 121 to travel beyond the reflective region of the second reflector 122 may be reflected back to the second reflector 122. As a result, optical loss may be prevented.

In addition, the auxiliary reflector 123 is disposed at a rear side of (behind) the second light source 121 such that light emitted from the second light source 121 is reflected by the second reflector 122 and the auxiliary reflector 123, thereby forming a reinforcement beam pattern by the light reflected by the auxiliary reflector 123.

In FIG. 23, the auxiliary reflector 123 is illustrated as being provided at the lamp 1 of FIG. 20, but the invention is not limited thereto. That is, the auxiliary reflector 123 is also applicable to the lamp 1 of the first, second, or third exemplary embodiment.

In the fourth exemplary embodiment, the auxiliary reflector 123 may be provided in the second light source module 120, but the invention is not limited thereto. That is, the auxiliary reflector 123 may also be provided in the first light source module 110 to be disposed near a first light source 111.

In the fourth exemplary embodiment, like in the second or third exemplary embodiment, the auxiliary reflector 123 is provided in the lamp 1 where a plurality of light-emitting modules are provided, but the invention is not limited thereto. That is, the auxiliary reflector 123 may also be provided in a lamp where only a single light-emitting unit or module is provided, such as the lamp 1 of the first exemplary embodiment.

In a case when the light-emitting unit 100 includes the first light source module 110 and the second light source module 120, as in the second, third or fourth exemplary embodiment, the first light source module 110 and the second light source module 120 may maintain to be turned on even during the switching between beam patterns, and the switching between beam patterns may be performed by the shield unit 200.

Since the first light source module 110 and the second light source module 120 are configured to continue to be turned on even during the switching between beam patterns, no or only a few structures for turning on or off the first light source module 110 and the second light source module 120 are needed. Accordingly, the structure of the lamp 1 may be simplified, and the manufacturing cost of the lamp 1 may be lowered.

While the invention has been particularly shown and described with reference to exemplary embodiments thereof, it will be understood by those of ordinary skill in the art that various changes in provide and detail may be made therein without departing from the spirit and scope of the invention as defined by the following claims. The exemplary embodiments should be considered in a descriptive sense only and not for purposes of limitation.

What is claimed is:

1. A lamp for a vehicle, comprising:

a light-emitting unit including a light source generating light and a reflector to reflect forward the light generated by the light source;

a shield unit to form a beam pattern by blocking at least some of the light generated by the light-emitting unit; and a lens unit disposed at a front of the shield unit, wherein the shield unit includes a first shield, which forms a first region of the shield unit, and a second shield, which is driven to cover or uncover a second region of the shield unit, wherein a reflective layer for reflecting the light blocked by the shield unit toward an upper side of the lens unit is formed on at least a portion of the shield unit.

2. The lamp of claim 1, wherein the shield unit has a shape of a plate that is at least partially horizontal.

3. The lamp of claim 1, wherein the first shield is fixedly installed.

4. The lamp of claim 1, wherein the first shield includes a mounting groove, on or from which the second shield is mounted or removed.

5. The lamp of claim 1, wherein the second region is a region formed to extend from a front end of the shield unit to a rearward direction.

6. The lamp of claim 1, wherein the second shield uncovers the second region by being rotated about a rotation axis to the front of the shield unit.

7. The lamp of claim 1, wherein a guide area is formed at least one side of the second shield.

8. The lamp of claim 7, wherein the guide area includes a guide groove into which a guide protrusion that is formed on the first shield is inserted.

9. The lamp of claim 1, wherein the shield unit forms a low beam pattern in response to the second region being covered and forms a high beam pattern in response to the second region being uncovered.

10. The lamp of claim 9, wherein the shield unit reflects light blocked by the first shield toward the upper side of the lens unit in response to the second region being uncovered.

11. The lamp of claim 1, wherein the light-emitting unit includes a first light source module and a second light source module, which are disposed in different directions from each other with respect to an optical axis.

12. The lamp of claim 11, wherein the first light source module is disposed above the optical axis and the second light source module is disposed below the optical axis.

13. The lamp of claim 1, wherein the light-emitting unit further includes an auxiliary reflector disposed near the light source.

14. The lamp of claim 13, wherein the auxiliary reflector is disposed at a front side of the light source to reflect light emitted from the light source to travel beyond a reflective region of the reflector back to the reflective region of the reflector.

15. The lamp of claim 13, wherein the auxiliary reflector is disposed at a rear side of the light source to reflect light emitted from the light source to form a reinforcement beam pattern.

16. The lamp of claim 1, wherein the shield unit further includes a light-transmitting portion, which is formed between the first shield and the second shield in response to the second region being covered.

17. The lamp of claim 16, wherein the light-transmitting portion is formed near a rear focal point of the lens unit.

18. The lamp of claim 16, wherein the light-transmitting portion forms a reinforcement beam pattern, which reinforces a predetermined portion of a beam pattern formed by the shield unit blocking some of the light generated by the light-emitting unit.

19. The lamp of claim 18, wherein the light-emitting unit includes a plurality of light-emitting modules, which are disposed in different directions from each other with respect to an optical axis, and the light-transmitting portion transmits therethrough light generated by at least one of the plurality of light-emitting modules so as to reinforce a predetermined portion of a beam pattern formed by the shield unit blocking some of the light generated by another one of the plurality of light-emitting modules.

* * * * *